United States Patent [19]

Nord

[11] 4,433,526

[45] Feb. 28, 1984

[54] PACKAGING MACHINE

[75] Inventor: Keith W. Nord, Stillwater, Minn.

[73] Assignee: Ex-Cell-O Corporation, Troy, Mich.

[21] Appl. No.: 252,092

[22] Filed: Apr. 8, 1981

[51] Int. Cl.[3] ..... B65B 5/08; B65B 21/14

[52] U.S. Cl. ..... 53/244; 53/247; 53/252; 53/534

[58] Field of Search ..... 53/244, 74, 251–253, 53/534, 537, 246–247

[56] References Cited

U.S. PATENT DOCUMENTS

| | | | |
|---|---|---|---|
| 2,770,935 | 11/1956 | Nigrelli | 53/253 X |
| 2,900,775 | 8/1959 | Carlson | 53/534 |
| 3,332,200 | 7/1967 | Englander | 53/244 X |
| 3,744,213 | 7/1973 | Pearson | 53/243 |

*Primary Examiner*—A. J. Heinz
*Attorney, Agent, or Firm*—John P. Moran

[57] ABSTRACT

The packaging machine illustrated and described herein is adaptable to loading bottles or cartons into cases. The machine includes a frame, a spider mechanism rotatably mounted on the frame for transporting containers to be loaded, a guide plate located adjacent the edge of the path of the spider mechanism and extending along a predetermined circumferential lower portion thereof, a chute for conveying cases past the guide plate, an opening formed through a wall of the chute adjacent the upper edge of the guide plate for communication with the open ends of the cases, a stop mechanism for controlling the movement of the cases past the opening in an indexing manner, and control means for controlling the simultaneous indexing of the stop mechanism and the spider mechanism so as to assure that each successive layer of containers will be fed by the spider mechanism so as to slide through the opening into the space of the next available row within the respective cases.

6 Claims, 5 Drawing Figures

PACKAGING MACHINE

TECHNICAL FIELD

This invention relates generally to article loading or packaging machinery and, more particularly, to machines for feeding cartons or bottles into boxes or cases.

BACKGROUND ART

Present machines for loading articles into packing cases generally require the pushing of the articles from a conveyor onto a floor or plate means, and then quickly removing the latter from underneath a group of the articles, such that the articles either fall by gravity, or are gripped at their tops by a suitable gripping head and lowered into boxes or cases disposed on a conveyor beneath the floor means.

DISCLOSURE OF THE INVENTION

A general object of the invention is to provide an improved article loading machine which is compact, simplified, and efficient in operation.

Another object of the invention is to provide a spider mechanism adapted to transfer cartons into a predetermined circumferential position, and then load same in layers into adjacent cases.

A further object of the invention is to provide a case loading machine, or caser, wherein single layers of bottles or cartons to be loaded are received by a rotating spider mechanism, and indexed to a position wherein the articles slide under the force of gravity in one embodiment of the invention, or are pushed in another embodiment of the invention into adjacent cases, which are being indexed simultaneously with the spider so as to receive the respective layers of bottles or cartons.

These and other objects and advantages of the invention will be apparent when reference is made to the following description and accompanying drawings, wherein:

BEST MODE OF CARRYING OUT THE INVENTION

Figure 1:
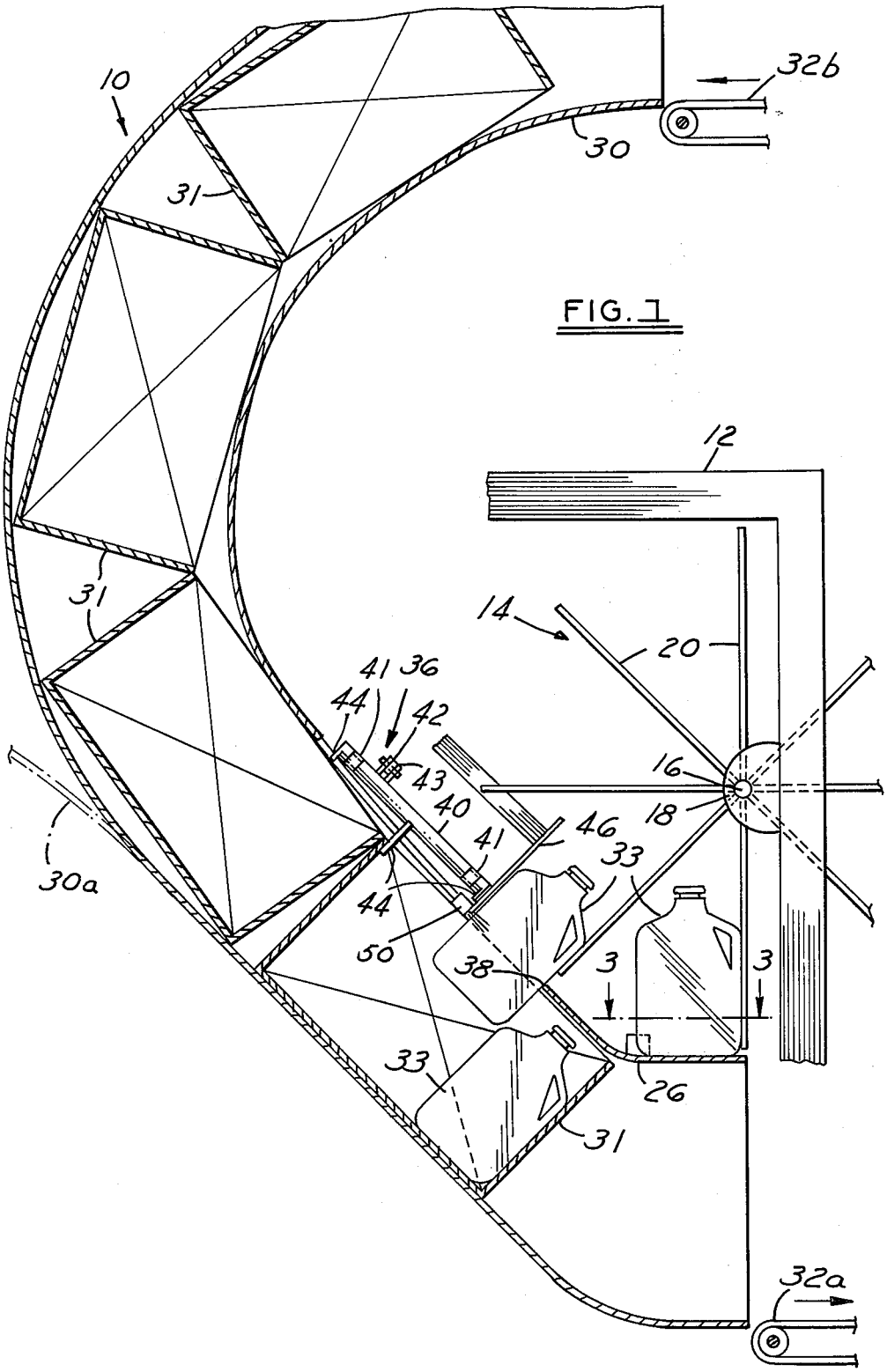
FIG. 1 is a fragmentary cross sectional schematic view of one embodiment of the invention.

Referring now to the drawings in greater detail, FIG. 1 illustrates a rotary caser 10, including a frame 12 having a rotator or spider mechanism 14 rotatably mounted on the frame by a shaft 16 mounted in suitable bearings 18. The rotator 14 includes a plurality of, say, eight (FIG. 1) or nine (FIG. 2) equally spaced radial arms or shelves 20 extending from the shaft 16. Each shelf 20 preferably consists of a plurality of laterally spaced tubular members 22 (FIG. 3) extending from points along the shaft 16 intermediate the sides 24 of the frame 12.

A guide plate 26 having a flat bottom portion and a substantially arcuate shaped portion extending upwardly therefrom is also mounted intermediate the frame sides 24 just outwardly of the path of the radially outer ends of the shelves 20, for a purpose to be described. One end of the guide plate 25 is positioned directly beneath the axis of the shaft 16, just radially beyond the path of the spider arms 20, with the other end thereof extending in a clockwise direction therefrom in each of the embodiments of FIGS. 1 and 2. An infeed shelf 28 is secured to the frame 12 adjacent an edge of the lower portion of the guide plate 26.

An infeed chute 30 having a rectangular cross section is mounted so as to extend in an arcuate configuration from above the upper end of the guide plate 26 and downwardly past the outer surface of the guide plate, to tie in at the exit end thereof with a suitable discharge conveyor 32*a*. The infeed chute 30 is adapted to receive cases 31 at the inlet end thereof from any suitable infeed conveyor or loading means 32*b*, while the lower portion of the guide plate 26 is adapted to receive bottles or cartons 33 from a suitable infeed conveyor 34 (FIG. 3) positioned adjacent the outer edge thereof. As an alternate arrangement, the chute could be located so as to receive the cases 31 in an upright position by entering from the left in FIG. 1, as represented by the phantom lines 30*a*.

Figure 4:
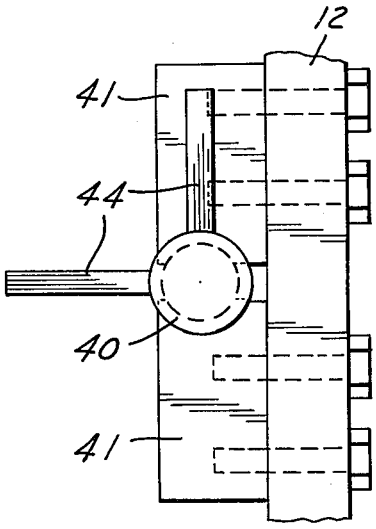
FIG. 4 is an enlarged fragmentary view of a portion of the FIG. 2 structure.

An indexing case stop mechanism 36 is rotatably mounted on a side of the chute 30 adjacent the upper edge of an opening 38 formed in a wall of the chute. The opening is formed just past the upper end of the guide plates 26. The stop mechanism 36 includes a shaft 40 of a predetermined length rotatably mounted in bearings 41 fixedly secured to the frame 12 by any convenient means, such as that shown in FIG. 4. A bracket 42 is secured to the shaft 40, adapted to being reciprocally pivoted by a suitable cylinder means 43. A plurality of equally spaced, radially outwardly extending, finger-like stop members 44 are formed on the shaft 40. Depending upon the sizes of the containers 35 being handled, either three (FIG. 1) or four (FIG. 2) stop members 44 are required, extending in predetermined radial directions from the shaft 40. Alternate stop members 44 in both arrangements extend in the same radial direction.

In the FIG. 1 embodiment, a fixed bottle guide wall 46 extends in a direction perpendicular to the plane of the open top of the adjacent case 33 and positioned along side the lower stop member 44. If the wall 46 is tall enough to interfere with the path of the rotator 14, it is formed of spaced rods or bars in order that the rotating tubular members 22 of the rotator 14 may pass therebetween.

Figure 2:
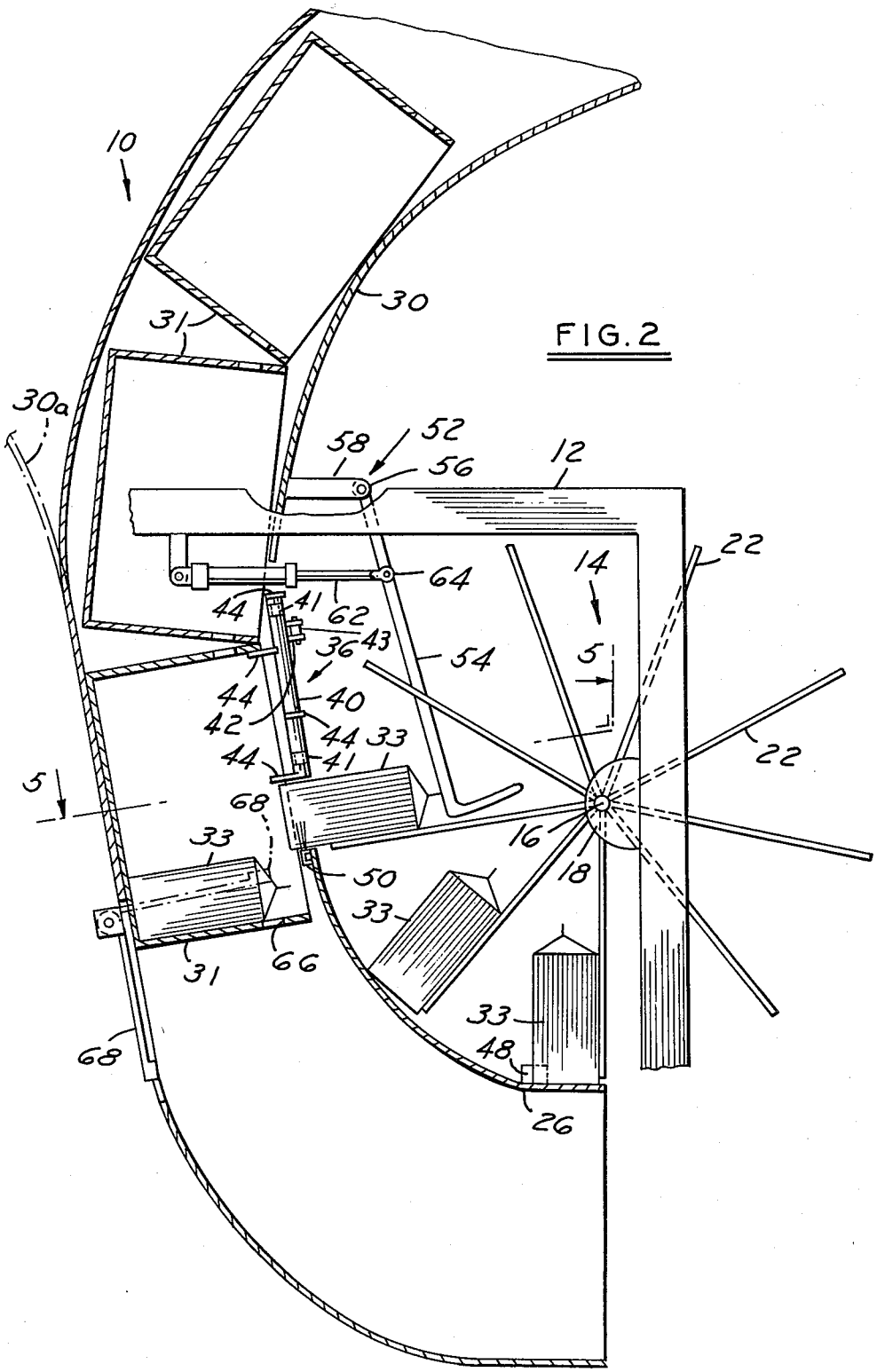
FIG. 2 is a fragmentary cross sectional schematic view of a second embodiment of the invention.
Figure 5:
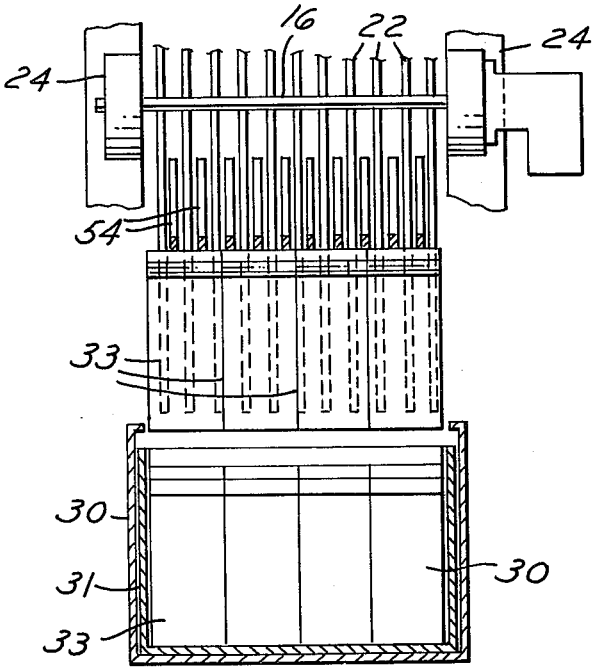
FIG. 5 is a cross sectional view taken along the plane of the line 5—5 of FIG. 2, and looking in the direction of the arrows.
Figure 3:
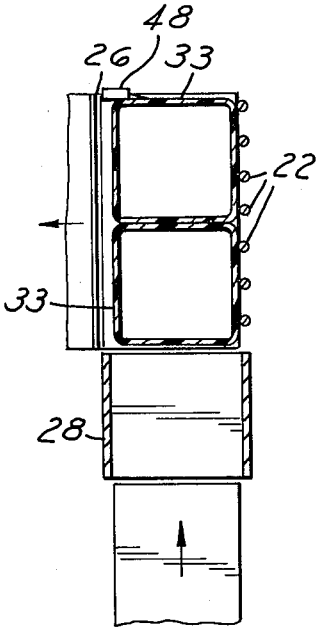
FIG. 3 is a fragmentary cross sectional view taken along the plane of the line 3—3 of FIG. 1, and looking in the direction of the arrows.

An electric eye or other suitable limit switch, represented at 48, is mounted at the far end of the guide plate 26, opposite the infeed shelf 28, so as to be actuated upon being contacted by a container 33, indicating that the width of the guide plate is filled, and causing the rotator 14 to index through one 45° increment (40° for FIG. 2). A second electric eye, or other suitable limit switch, represented at 50, is mounted on the frame 12 so as to be operative in the opening 38, and is adapted to coordinate the indexing of the rotator 14 and the stop mechanism 36, upon being actuated by bottles or carbons 35 in a manner to be described.

As shown in the FIG. 2 embodiment, carton pusher mechanism 52 is mounted at a predetermined location on the chute 30. The pusher mechanism 52 includes a plurality of pusher bars 54, each having one end thereof connected by a pivot 56 to a bracket 58 secured to the wall of the chute 30. The pusher bars 54 extend into the path of the rotator 14 intermediate respective tubular members 22. Suitable cylinder means 60 is mounted on the chute 30, with a cylinder rod 62 thereof connected by a pivot 64 to an intermediate point along the pusher bars 54 for reciprocally actuating the pusher bars about the pivot 56. In this arrangement, it is the pusher bar 54 which serves to actuate the limit switch 50, to cause the shaft 40 to pivot.

In the event the cases 31 have hand openings 66 formed in the ends thereof, and when such cases are to be loaded with small cartons 35, it may be necessary to have a bar 68 mounted by a pivot 70 on the chute 30, and adapted to being pivoted along side the lower end of each case 31 in order that a small block member 72 mounted on the bar 68 may serve to fill the hand opening 66 in the case, to assure that a carton 33 in the first row of cartons does not get hung up on an inner edge of the opening. As with the FIG. 1 embodiment, the chute 30 could enter from the left in FIG. 2, as represented by the phantom lines 30*a*.

OPERATION

Referring now to the FIG. 1 arrangement, wherein the eight shelves 20 are spaced 45° apart, gallon size plastic jugs 38 are fed by the conveyor 34 across the infeed shelf 28 onto the guide plate 26. Once one or more jugs, as desired, are in place on the latter, the rotator 14 is caused by the limit switch 48 to rotate through 45° in a clockwise direction, sliding the jugs upwardly along the guide plate 26 to a position in alignment with the opening 38, whereupon the jugs slide under the force of gravity off the shelf 20, through the opening 38, into a case 31, forming a first row thereacross. At this point the case 31 is retained by virtue of the upper stop member 44 being abutted against the inner surface of the upper end wall of the case. The cases, of course, have been fed into the chute 30 by the infeed conveyor 32*b*.

Actuation of the limit switch 50 by the jugs 33 as they pass through the opening 38 actuates the cylinder means 43, causing the rotator 14 and the stop mechanism 36 to rotate. Rotation of the upper stop member 44 out of the case 31 permits the case to drop under the force of gravity until the upper end wall engages the next stop member 44 which has been rotated into the case 31. The next row of jugs 33 are now ready, by virtue of the rotation of the rotator 14 through another 45° increment, to slide into the case along the preceeding row or jugs, coming to rest thereagainst upon contacting the bottom of the case. One more cycle, with the case now stopped by the third stop member 44, which has been reciprocally moved into position by the cylinder means 43, causes the case to become filled, after which the third stop member 44 is rotated out of the case, releasing the case to move down out of the chute 30 onto the discharge conveyor 32*a*.

Referring now to the FIG. 2 arrangement, the operation thereof is similar to that of the FIG. 1 unit, except that the opening 38 is higher and, thus, substantially vertically oriented. Once a row of conventional paperboard cartons 35 has been rotated through two 40° increments, the pusher bars 54 of the mechanism 52 are actuated to push the cartons through the opening 38 into the case 33, forming the first row therein and, thence, progressively filling the latter in substantially the same manner as for the FIG. 1 arrangement.

INDUSTRIAL APPLICABILITY

It should be apparent that the rotary caser arrangement provides a simple and efficient means for loading containers into cases without their free-falling or having to be gripped by their top and lowered into the cases.

While but two embodiments of the invention have been shown and described, other modifications thereof are possible.

The embodiments of the invention in which an exclusive property or privilege is claimed are defined as follows:

1. A case loading machine comprising a frame, a spider mechanism rotatably mounted on a shaft having the ends thereof supported on said frame and including radially extending shelves for transporting in a circular path containers to be loaded into cases with each shelf carrying one or more containers, a guide plate secured to said frame adjacent a predetermined circumferential portion of the circular path swept-out by said shelves wherein said guide plate supports said containers being transported by said shelves, a chute having an elongated passage for conveying cases past said guide plate, an opening formed through a wall of said chute adjacent said guide plate for communication with the open tops of the cases, a stop mechanism including means rotatably mounted on said frame, said shaft means having a predetermined number of fingers extending radially therefrom in different radial directions and longitudinally spaced along the length of said chute, wherein certain ones of said fingers extend into the path of movement of said cases for alternately engaging said cases and thereby controlling the movement of the cases past said opening, means for rotating said shaft means such that said case are controlled by said fingers to advance in repeated movements each equal to the distance of the width of one row of containers, and electrical means for coordinating the movements of the stop mechanism and the spider mechanism whereby successive layers of one or more containers are fed from the respective shelves of the spider mechanism as such respective shelves pass by said opening into the space of the next available row within the respective cases as said stop mechanism permits each case to drop under the force of gravity the distance of one container row width.

2. The case loading machine described in claim 1, wherein the containers feed through said opening under the force of gravity.

3. The case loading machine described in claim 1, and including a pusher mechanism adapted to push the containers through said opening.

4. The case loading machine described in claim 3, wherein each of said radial shelves and said pusher mechanism include laterally spaced tubular members interdigitally related to one another.

5. The case loading machine described in claim 1, wherein the electrical means is a photo electric unit.

6. The case loading machine described in claim 1, wherein the electrical means is a limit switch arrangement.

* * * * *

UNITED STATES PATENT OFFICE

CERTIFICATE OF CORRECTION

Patent No. 4,433,526 Dated February 28, 1984

Inventor(s) Keith W. Nord

It is certified that error appears in the above-identified patent and that said Letters Patent are hereby corrected as shown below:

claim 1, column 4, line 31, between "including" and "means", insert --shaft--.

claim 1, column 4, line 40, delete "case" and substitute therefor --cases--.

Signed and Sealed this

Twelfth Day of June 1984

[SEAL]

*Attest:*

GERALD J. MOSSINGHOFF

*Attesting Officer*

*Commissioner of Patents and Trademarks*